United States Patent [19]

Massey

[11] 4,098,409

[45] Jul. 4, 1978

[54] FOLDABLE SHIPPING RACK

[75] Inventor: Cleo E. Massey, Flint, Mich.

[73] Assignee: Moore Iron Works, Flint, Mich.

[21] Appl. No.: 774,388

[22] Filed: Mar. 4, 1977

[51] Int. Cl.[2] ..... A47F 5/10

[52] U.S. Cl. ..... 211/195; 105/367; 108/53.5; 206/319; 211/194; 248/3; 248/119 R

[58] Field of Search ..... 211/195, 194, 188, 149; 248/119 R, 3; 108/53.5, 55.1; 206/319; 105/366 E, 366 D, 367, 368 R; 5/178, 179, 180; 297/357, 378, 379

[56] References Cited

U.S. PATENT DOCUMENTS

| | | | |
|---|---|---|---|
| 2,956,763 | 10/1960 | D'Arca | 211/195 X |
| 3,061,328 | 10/1962 | Konar | 297/357 X |
| 3,353,771 | 11/1967 | Tebow | 248/3 |
| 3,499,398 | 3/1970 | Murray | 108/53.5 |
| 3,665,869 | 5/1972 | Howe | 108/53.5 X |
| 3,675,795 | 7/1972 | Dluhy | 248/119 X |

FOREIGN PATENT DOCUMENTS

| | | | |
|---|---|---|---|
| 200,097 | 11/1955 | Australia | 211/194 |

*Primary Examiner*—Ramon S. Britts

*Attorney, Agent, or Firm*—Barnes, Kisselle, Raisch & Choate

[57] ABSTRACT

A foldable shipping rack comprising a base frame having portions adapted to engage a flat surface and end frames supported on the base frame and guided for movement between a first locked position wherein each end frame is in upright position with respect to the base frame and a folded position wherein each end frame is in substantial parallel relation to the base frame.

10 Claims, 6 Drawing Figures

FOLDABLE SHIPPING RACK

This invention relates to foldable storage racks and particularly to foldable storage racks for transporting engines for automotive vehicles.

BACKGROUND AND SUMMARY OF THE INVENTION

In the handling of engines, it is common to provide a temporary storage rack for transporting the engines by trucks or otherwise between an engine plant and an assembly plant. If the rack is made sufficiently strong to withstand the abuses of transportation as well as of stacking one on the other, it has heretofore been difficult to provide a readily foldable rack. As a result, the volume of the rack could not be reduced for return to the engine plant.

Accordingly, among the objects of the invention are to provide a foldable storage rack which has sufficient strength to withstand the normal forces occurring in transportation and yet can be folded for return; and wherein the parts of the rack when in unfolded condition are locked efficiently; and wherein the rack can be manufactured at low cost without sacrificing strength.

DESCRIPTION

Figure 2:
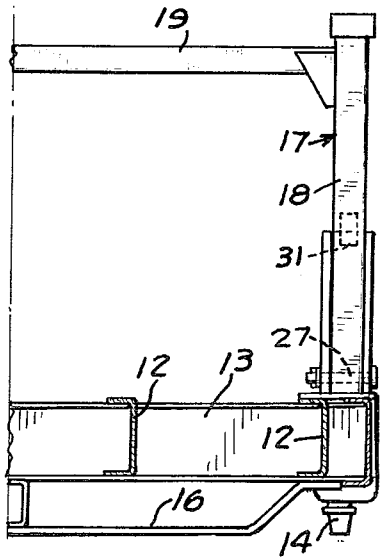
FIG. 2 is a fragmentary sectional view taken along the line 2—2 in FIG. 1.
Figure 3:
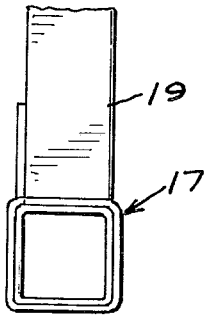
FIG. 3 is a fragmentary view on an enlarged scale taken along the line 3—3 in FIG. 1.
Figure 1:
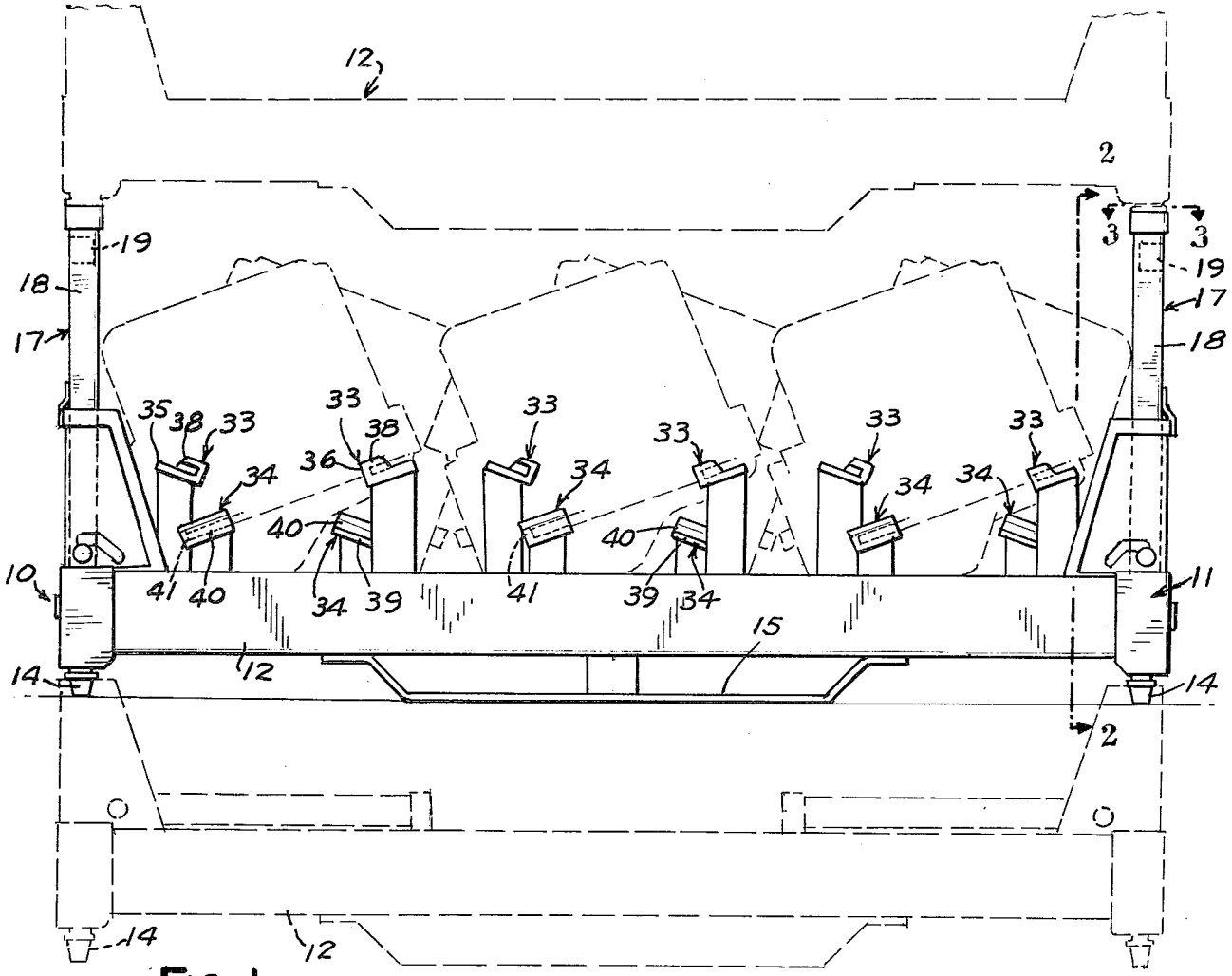
FIG. 1 is a side elevational view of the storage rack embodying the invention showing the rack in stacked position with other racks.

Referring to FIGS. 1 and 2, the foldable shipping rack 10 comprises a base frame 11 that is made up of spaced parallel longitudinal channels 12 and transverse members 13. The base frame 11 includes ground engaging pads or feet 14 at the corners thereof and strengthening members 15, 16 attached to one or more the channels 12. The shipping rack 10 further includes end frames 17, each of which comprises tubular upright members 18 connected by a transverse tubular member 19 that extends between the upper ends of the members 18.

Figures 4, 5, 6:
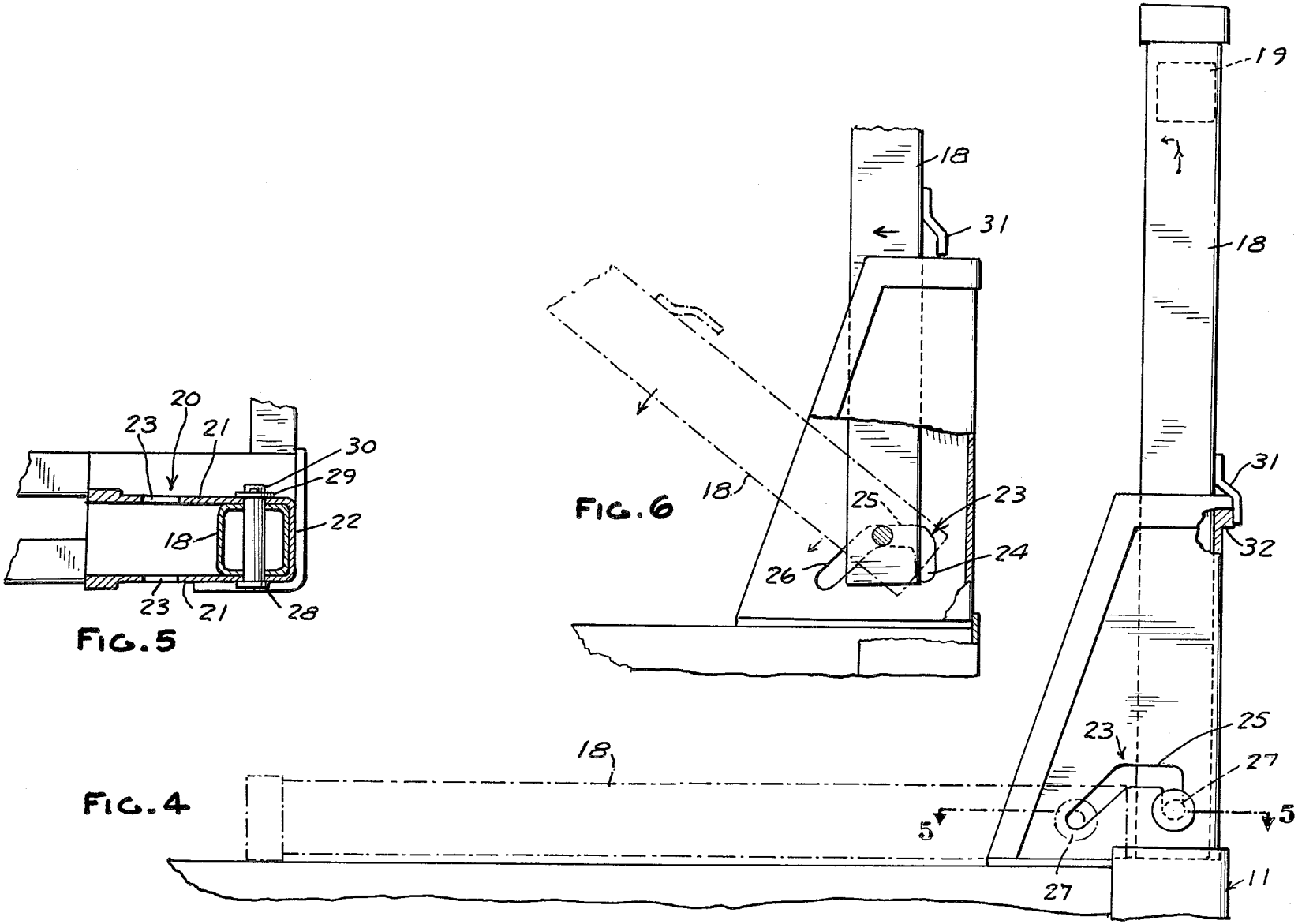
FIG. 4 is a fragmentary side elevational view on an enlarged scale of a portion of the rack shown in FIG. 1.
FIG. 5 is a fragmentary sectional view taken along the line 5—5 in FIG. 4.
FIG. 6 is a fragmentary view similar to FIG. 4 showing the parts in partially folded condition.

As presently described, means are provided for supporting each end frame 17 for movement between an upright locked position wherein the end frame 17 is at a right angle to the base frame 11 and a folded position wherein the end frame 17 is generally parallel to the base frame 11. This means comprises frame supports 20 fastened to the corners of the base frame 11 and comprising upstanding vertical wall portions 21 and an end wall 22 (FIGS. 4–6). The upright 18 at each end of an end frame 17 extends between the walls 21 and when the end frame 17 is in upright position engages the plate 22 on base frame 11. Each wall 21 is provided with a slot 23 that is in the form of a generally inverted U shape having side edges defining a first vertical leg 24, a horizontal base leg 25, and a second leg 26 extending downwardly and inwardly. The slots 23 in the walls 21 are aligned with one another. A pin 27 extends through upright 18 at each corner of the end frame and also through the slots 23. The pin 27 has a head 28 at one end and includes a washer 29 held in position by a cotter pin 20 so that the pin 27 is maintained in the slots 23 (FIG. 5).

When the upright frame 17 is in the unfolded upright position, the lower end of the members 18 engages plate 22 on the base frame 11 and the pin 27 is in the lower end of the leg 24 of slot 23. In addition, a hook 31 in upright 18 engages a transverse portion 32 on the support 20 to further lock the frame in upright position. When it is desired to fold the end frame, it is lifted manually causing the pin 27 to move upwardly in the leg 24 and at the same time disengaging the hook 31 from the projection. When the upper end of the end frame is thereafter moved forwardly, the pin 27 is guided by the base leg 25 (FIG. 6) of each slot 23 to the second leg 26 downwardly and inwardly bringing the end frame 17 into folded position parallel to the base frame 11, as shown in broken lines in FIG. 4.

As shown in FIG. 1, the rack includes a plurality of work supports 33, 34, each of which has support surfaces for receiving the base flange of an engine. As shown, the supports 33, 34 are adapted to support an engine at an angle to the horizontal and six engines are provided on the rack in two rows of three each. A pair of supports 33 and a pair of supports 34 are provided for each engine.

Each support 34 of a pair of supports 33 is a mirror image of the other and comprises a base wall 35, a side wall 36, a rear wall 37 defining a horizontal stop and a top wall 38 defining a vertical stop. Walls 35, 38 are spaced from one another to define a slot for receiving the base flange of the engine and are inclined to the horizontal. Each support 34 of a pair of supports 34 is a mirror image of the other and comprises a base wall 39, side wall 40 and a rear wall 41. Base wall 39 is inclined to the horizontal at the same angle as base walls 35 of brackets 33, so that the engine is inclined to the horizontal. The side walls 36, 40 are inclined to a longitudinal plane through the rack and laterally restrain the engine. As a result, each engine is supported so that its axis is skewed with respect to the longitudinal and transverse axes of the rack and one end of the engine is lower than the other. The engines on one side of the rack have their axes extending oppositely to the engines on the other side of the rack.

As shown in FIG. 1, pad or foot 14 of the rack engages the frame support 20 below it so that the racks can be easily stored in folded position. Similarly, the feet 14 engage recesses in the upper ends of side frame 17 so that the racks can be stacked with the engines or other components therein.

I claim:

1. In a foldable shipping rack, the combination comprising a base frame, said base frame having portions adapted to engage a flat surface, and end frames, means for supporting each end frame on the base frame and for guiding said end frame for movement between a first locked position wherein the end frame is in upright position with respect to the base frame and a folded position wherein the end frame is in substantial parallel relation to the base frame, said means for mounting and guiding said end frame comprising a frame support on said base frame, said frame support including a generally inverted U-shaped slot having side edges defining a first leg extending generally vertically, a second leg extending generally horizontally and inwardly, and a third leg extending downwardly and inwardly of the base frame, a pin mounted on said end frame and extending through said slot in a position such that when the end frame is in upright position, the pin is at the lower end of the first leg, and when the end frame is elevated, the pin is guided by the side edges of said second and third legs of the slot to guide the end frame to the folded position.

2. The combination set forth in claim 1 wherein said slot extends through said frame support.

3. The combination set forth in claim 2 wherein said frame support comprises spaced vertically extending portions, each of which has one said slot therein, said end frame having the portion thereof with the pin thereon extending through said slots in said spaced vertical portions.

4. The combination set forth in claim 3 wherein said support includes an end wall between said vertical portions, said end frame engaging said end wall when said end frame is in upright position.

5. The combination set forth in claim 1 including a plurality of sets of engine supports on said base frame, each said support including a surface for slidably and removably receiving a portion of an engine, and means on at least some of said supports for limiting the movement of the engine downwardly toward said base frame.

6. The combination set forth in claim 5 wherein the support surfaces of each set for supports are inclined in such a manner that the engine is skewed with respect to the longitudinal and transverse axes of the rack.

7. In a foldable shipping rack, the combination comprising a base frame, said base frame having portions adapted to engage a flat surface, and end frames comprising spaced members extending vertically when the end frame is in upright position, means for supporting each end frame on the base frame and for guiding said end frame for movement between a first locked position wherein the end frame is in upright position with respect to the base frame and a folded position wherein the end frame is in substantial parallel relation to the base frame, said means for mounting and guiding said end frame comprises a frame support on said base frame, said frame support comprises vertically extending portions, which have aligned slots therein, each said slot in said frame support having side edges defining a generally inverted U-shaped slot including a first leg extending generally vertically, a second leg extending generally horizontally and inwardly, and a third leg extending downwardly and inwardly of the base frame, a pin mounted on said upright portion of said end frame and extending through said slots in a position such that when the end frame is in upright position, the pin is at the lower end of the first leg, and when the end frame is elevated, the pin is guided by the side edges of said second and third legs of the slots to guide the end frame to the folded position.

8. The combination set forth in claim 7 wherein said support includes an end wall between said vertical portions, said end frame engaging said end wall when said end frame is in upright position.

9. In a foldable shipping rack, the combination comprising a base frame, said base frame having portions adapted to engage a flat surface, and end frames, a plurality of sets of engine supports on said base frame, each said support including a surface for slidably and removably receiving a portion of an engine.

and means on at least some of said supports for limiting the movement of the engine downwardly toward said base frame.

10. The combination set forth in claim 9 wherein the support surfaces of each set of supports are inclined in such a manner that the engine is skewed with respect to the longitudinal and transverse axes of the rack.

* * * * *